US011851765B2

(12) United States Patent
Kim et al.

(10) Patent No.: US 11,851,765 B2
(45) Date of Patent: Dec. 26, 2023

(54) HOME APPLIANCE METAL MATERIALS CHEMICALLY RESISTANT TO PEROXIDE DEGRADATION

(71) Applicant: Robert Bosch GmbH, Stuttgart (DE)

(72) Inventors: Soo Kim, Cambridge, MA (US); Jonathan Mailoa, Cambridge, MA (US); Lei Cheng, San Jose, CA (US); Charles Tuffile, Swansea, MA (US)

(73) Assignee: Robert Bosch GmbH, Stuttgart (DE)

( * ) Notice: Subject to any disclaimer, the term of this patent is extended or adjusted under 35 U.S.C. 154(b) by 617 days.

(21) Appl. No.: 17/004,162

(22) Filed: Aug. 27, 2020

(65) Prior Publication Data

US 2022/0064802 A1 Mar. 3, 2022

(51) Int. Cl.

| | |
|---|---|
| ***C23C 22/54*** | (2006.01) |
| ***C23C 22/52*** | (2006.01) |
| ***C23C 22/53*** | (2006.01) |

(52) U.S. Cl.

CPC ..... *C23C 22/52* (2013.01); *C23C 22/53* (2013.01); *C23C 22/54* (2013.01)

(58) Field of Classification Search

CPC ..... A47L 15/0057; A47L 15/4251; C23C 22/52–54

See application file for complete search history.

(56) References Cited

U.S. PATENT DOCUMENTS

2015/0028220 A1 1/2015 Poppi et al.

OTHER PUBLICATIONS

Kadossov et al., "Density-functional studies of hydrogen peroxide adsorption and dissociation on MoO3(100) and H0.33MoO3(100) surfaces", RSC Advances, DOI: 10.1039/c5ra08006a, Nov. 9, 2015, RSC Adv., 2015, 5, 97755-97763, 9 pages.

Zuo et al., Efficient photocatalytic hydrogen peroxide production over TiO2 passivated by SnO2, University of Wollongong, Australian Institute for Innovative Materials—Papers, 2019, 11 pages.

*Primary Examiner* — Lois L Zheng

(74) *Attorney, Agent, or Firm* — Brooks Kushman P.C.

(57) ABSTRACT

A home appliance chemically resistant to peroxide degradation. The home appliance includes a metal substrate disposed therein that includes a metal substrate having a bulk portion and a coating layer contacting a surface of the bulk portion. The coating layer includes a ternary metal oxide compound, a metal alloy, an intermetallic compound, or a combination thereof. The ternary metal oxide compound, the metal alloy or the intermetallic compound is (a) unreactive with hydrogen peroxide or (b)(1) reactive with hydrogen peroxide to form one or more metal oxides unreactive with hydrogen peroxide or reactive with hydrogen peroxide to form one or more metal oxides unreactive with hydrogen peroxide and/or (b)(2) reactive with hydrogen peroxide to form one or more elemental metals reactive with hydrogen peroxide to form one or more metal oxides.

20 Claims, 4 Drawing Sheets

HOME APPLIANCE METAL MATERIALS CHEMICALLY RESISTANT TO PEROXIDE DEGRADATION

TECHNICAL FIELD

The present disclosure relates to metal materials chemically resistant to peroxide (e.g. hydrogen peroxide) degradation. In certain embodiments, the metal materials form substrates and/or coatings disposed within a home appliance, such as a dishwasher or a washing machine.

BACKGROUND

Hydrogen peroxide is often used to clean, sanitize and/or disinfect dishwashers, including metal surfaces in dishwashers. In some applications, the hydrogen peroxide can be mixed with dishwashing liquid cleaning solution to create an effective cleaning agent. Hydrogen peroxide can also be used to wash away dish soap residue on metal surfaces in a dishwasher. Hydrogen peroxide is active against a wide range of microorganisms, including bacteria, yeasts, fungi, viruses, and spores, thereby showing effectiveness against these microorganisms residing on metal surfaces in dishwashers. While hydrogen peroxide is helpful for cleaning, sanitizing and/or disinfecting the inner and outer metal surfaces and parts of dishwashers, hydrogen peroxide may degrade these metal materials and surfaces over time.

SUMMARY

According to one embodiment, a home appliance includes a metal substrate therein that is chemically resistant to peroxide degradation. The metal substrate has a bulk portion and a surface portion. The bulk and/or surface portion includes an elemental metal having a decomposition reaction with hydrogen peroxide having a ratio of hydrogen peroxide to metal element of 10:1 to 1:10. The ratio of hydrogen peroxide to metal element and/or metal oxide may be any of the following values or in a range of any two of the following values: 10:1, 5:1, 3:1, 1:1, 1:2, 1:3, 1:5 and 1:10. The metal element is configured to impart chemical resistance to peroxide degradation.

According to another embodiment, a home appliance includes a metal substrate therein that is chemically resistant to peroxide degradation is disclosed. The metal substrate includes a metal substrate having a bulk portion and a coating layer contacting a surface of the bulk portion. The coating layer includes a metal hydroxide and/or a metal oxide of a decomposition reaction between the elemental metal and hydrogen peroxide. The metal hydroxide or a fully-oxidized metal oxide is unreactive with hydrogen peroxide.

In yet another embodiment, a home appliance including a metal substrate therein that is chemically resistant to peroxide degradation. The metal substrate has a bulk portion and a coating layer contacting a surface of the bulk portion. The coating layer includes a ternary metal oxide compound, a metal alloy, an intermetallic compound, or a combination thereof. The ternary metal oxide compound, the metal alloy or the intermetallic compound is (a) unreactive with hydrogen peroxide or (b)(1) reactive with hydrogen peroxide to form one or more metal oxides unreactive with hydrogen peroxide or reactive with hydrogen peroxide to form one or more metal oxides unreactive with hydrogen peroxide and/or (b)(2) reactive with hydrogen peroxide to form one or more elemental metals reactive with hydrogen peroxide to form one or more metal oxides unreactive with hydrogen peroxide.

DETAILED DESCRIPTION

Figure 1:
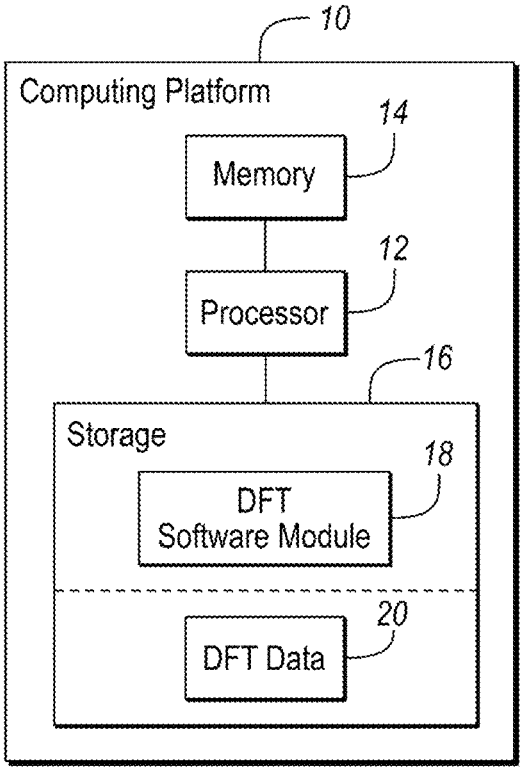
FIG. 1 is a schematic diagram of a computing platform that may be utilized to implement density functional theory (DFT) algorithms and/or methodologies of one or more embodiments.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of," and ratio values are by weight; the term "polymer" includes "oligomer," "copolymer," "terpolymer," and the like; the description of a group or class of materials as suitable or preferred for a given purpose in connection with the invention implies that mixtures of any two or more of the members of the group or class are equally suitable or preferred; molecular weights provided for any polymers refers to number average molecular weight; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

This invention is not limited to the specific embodiments and methods described below, as specific components and/or conditions may, of course, vary. Furthermore, the terminology used herein is used only for the purpose of describing particular embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" and/or "about" may be used herein to describe disclosed or claimed embodiments. The term "substantially" and/or "about" may modify any value or relative characteristic disclosed or claimed in the present disclosure. In such instances, "substantially" and/or "about" may signify that the value or relative characteristic it modifies is within ±0%, 0.1%, 0.5%, 1%, 2%, 3%, 4%, 5% or 10% of the value or relative characteristic.

It should also be appreciated that integer ranges explicitly include all intervening integers. For example, the integer range 1 to 10 explicitly includes 1, 2, 3, 4, 5, 6, 7, 8, 9, and 10. Similarly, the range 1 to 100 includes 1, 2, 3, 4 . . . . 97, 98, 99, 100. Similarly, when any range is called for, intervening numbers that are increments of the difference between the upper limit and the lower limit divided by 10 can be taken as alternative upper or lower limits. For example, if the range is 1.1. to 2.1 the following numbers 1.2, 1.3, 1.4, 1.5, 1.6, 1.7, 1.8, 1.9, and 2.0 can be selected as lower or upper limits.

In the examples set forth herein, concentrations, temperature, and reaction conditions (e.g., pressure, pH, flow rates, etc.) can be practiced with plus or minus 50 percent of the values indicated rounded to or truncated to two significant figures of the value provided in the examples. In a refinement, concentrations, temperature, and reaction conditions (e.g., pressure, pH, flow rates, etc.) can be practiced with plus or minus 30 percent of the values indicated rounded to or truncated to two significant figures of the value provided in the examples. In another refinement, concentrations, temperature, and reaction conditions (e.g., pressure, pH, flow rates, etc.) can be practiced with plus or minus 10 percent of the values indicated rounded to or truncated to two significant figures of the value provided in the examples.

The description of a group or class of materials as suitable for a given purpose in connection with one or more embodiments implies that mixtures of any two or more of the members of the group or class are suitable. Description of constituents in chemical terms refers to the constituents at the time of addition to any combination specified in the description, and does not necessarily preclude chemical interactions among constituents of the mixture once mixed. First definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

For all compounds expressed as an empirical chemical formula with a plurality of letters and numeric subscripts (e.g., $CH_2O$), values of the subscripts can be plus or minus 50 percent of the values indicated rounded to or truncated to two significant figures. For example, if $CH_2O$ is indicated, a compound of formula $C_{(0.8\text{-}1.2)}H_{(1.6\text{-}2.4)}O_{(0.8\text{-}1.2)}$. In a refinement, values of the subscripts can be plus or minus 30 percent of the values indicated rounded to or truncated to two significant figures. In still another refinement, values of the subscripts can be plus or minus 20 percent of the values indicated rounded to or truncated to two significant figures.

As used herein, the term "and/or" means that either all or only one of the elements of said group may be present. For example, "A and/or B" means "only A, or only B, or both A and B". In the case of "only A", the term also covers the possibility that B is absent, i.e. "only A, but not B".

Hydrogen peroxide is a chemical compound having the formula $H_2O_2$. Hydrogen peroxide is a clear liquid having a very pale blue tint in its pure form. Hydrogen peroxide is slightly more viscous than water. Hydrogen peroxide is the simplest form of a peroxide, which is a compound having a single bond between two oxygen atoms. Hydrogen peroxide has many uses, including as an oxidizer, antiseptic and bleaching agent. Hydrogen peroxide is a reactive compound in concentrated levels due to the instability of its peroxide bond. Concentrated hydrogen peroxide has been used as a rocket propellent due to its reactivity.

Hydrogen peroxide is a very strong oxidant that is thermodynamically unstable. This instability makes hydrogen peroxide easily decompose into water and oxygen by the following decomposition reaction (1):

$$H_2O_2 \rightarrow H_2O + O \quad (1)$$

The calculated reaction enthalpy of the $H_2O_2$ decomposition reaction is −0.084 eV/atom (or, −32.55 kJ/mol). $H_2O_2$ may oxidize metal surfaces and substrates, leading to degradation in the performance characteristics of these metal materials. For example, reacting Cu metal with $H_2O_2$ yields water and cupric oxide according to the following reaction (2):

$$H_2O_2 + Cu \rightarrow H_2O + CuO \quad (2)$$

Often the reaction products may involve species other than metal oxide ($MO_x$) and/or water ($H_2O$). For instance, it may be possible that the $H_2O_2$ reaction products may include without limitation gas species (e.g., $O_2$, $H_2$), metal hydrides ($MH_x$), metal hydroxide ($M(OH)_x$), or a combination thereof. Due to the nature of a peroxide group being a strong oxidizing agent, it may be difficult to control the resulting metal oxide formation or any other reaction products when metal is exposed to $H_2O_2$.

Hydrogen peroxide is often used to clean, sanitize and/or disinfect dishwashers, including metal surfaces in dishwashers. In some applications, the hydrogen peroxide can be mixed with dishwashing liquid cleaning solution to create an effective cleaning agent. Hydrogen peroxide can also be used to wash away dish soap residue on metal surfaces in a dishwasher. Hydrogen peroxide is active against a wide range of microorganisms, including bacteria, yeasts, fungi, viruses, and spores, thereby showing effectiveness against these microorganisms residing on metal surfaces in dishwashers. While hydrogen peroxide is helpful for cleaning, sanitizing and/or disinfecting the inner and outer metal surfaces and parts of dishwashers, hydrogen peroxide may degrade these metal materials and surfaces over time.

An electrochemical cell configured to produce hydrogen peroxide for cleaning, sanitizing and/or disinfecting may be present within a dishwasher. The electrochemical cell may include metal components (e.g. electrodes) subject to degradation by hydrogen peroxide produced by the electrochemical cell and/or other sources of hydrogen peroxide.

Accordingly, it is important to consider the potentially negative effects of peroxide compounds in an environment including metal materials. For instance, it has been proposed to use titanium (Ti) metal for applications that involve $H_2O_2$ because the resulting surface oxide (i.e. $TiO_2$) does not further decompose when in contact with $H_2O_2$. Fully-oxidized $TiO_2$ does not react with $H_2O_2$ according to the following reaction (3):

$$TiO_2+H_2O_2 \rightarrow TiO_2+H_2O_2 \quad (3)$$

The reaction product of $H_2O_2$ may further thermodynamically decompose to $H_2O$ and O, where Erxn=−0.084 eV/atom. However, other fully-oxidized metal oxides may further react with $H_2O_2$. For instance, aluminum (Al) metal reacting with $H_2O_2$ produces $Al_2O_3$ and $H_2$ gas, where gas evolution may be problematic, depending on the application. In addition, when $Al_2O_3$ further reacts with $H_2O_2$, it decomposes to $AlHO_2$ and $O_2$, leading to another $O_2$ gas evolution. In view of these observations, Al metal may not be suitable when compared to Ti metal for certain metal material applications in a $H_2O_2$ environment.

In light of the foregoing, metal materials are needed that are suitable for applications in which $H_2O_2$ is present. For instance, such applications include the operation of home appliances having internal metal substrates and/or components exposed to hydrogen peroxide, such as washing machines and dishwashers operating in the range of 20 to 70° C. These devices (e.g. washing machine and dishwasher devices) may include electrodes, electrochemical cells, valves, pipes and other metallic components. In one or more embodiments, metal compounds are determined based on their suitability in an $H_2O_2$ environment. These embodiments examine various metals, binary metals, ternary metals, and intermetallic compounds using a combination of first-principles density functional theory (DFT) slab models and data-driven materials screening approaches, thereby discovering a number of different chemically-resistant metal materials against $H_2O_2$ decomposition. Furthermore, the disclosure examines and identifies metal materials with low band gap energy (e.g. $E_g$ less than 1 eV), which may also be desirable for applications that require electrical conductance.

In one embodiment, first-principles DFT slab model algorithms and/or methodologies are used to model surface phenomenon and actual chemical interfaces between a metal material surface and chemicals present in the environment in which the metal material is applied. These calculations can be used to design and select metal materials for applications in which the environment includes aggressive chemical species, such as peroxides (e.g. $H_2O_2$). In one embodiment, the chemical present and examined is $H_2O_2$. As described below, the chemical molecule of $H_2O_2$ is represented using a single-atom adsorption of hydrogen (H) and oxygen (O). The binding energies of H and O are examined since $H_2O_2$ is known to be a strong oxidant and a weak acid. One or more embodiments evaluate how strongly or weakly the H and/or O may bind onto a metal material, e.g. a binary oxide or nitride.

The DFT slab model algorithms and/or methodologies of one or more embodiments are implemented using a computing platform, such as computing platform 10 illustrated in FIG. 1. The computing platform 10 may include a processor 12, memory 14, and non-volatile storage 16. Processor 12 may include one or more devices selected from high-performance computing (HPC) systems including high-performance cores, microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on computer-executable instructions residing in memory 14. Memory 14 may include a single memory device or a number of memory devices including, but not limited to, random access memory (RAM), volatile memory, non-volatile memory, static random access memory (SRAM), dynamic random access memory (DRAM), flash memory, cache memory, or any other device capable of storing information. Non-volatile storage 16 may include one or more persistent data storage devices such as a hard drive, optical drive, tape drive, non-volatile solid state device, cloud storage or any other device capable of persistently storing information.

Processor 12 may be configured to read into memory 14 and execute computer-executable instructions residing in DFT software module 18 of the non-volatile storage 16 and embodying DFT slab model algorithms and/or methodologies of one or more embodiments. Software module 18 may include operating systems and applications. Software module 18 may be compiled or interpreted from computer programs created using a variety of programming languages and/or technologies, including, without limitation, and either alone or in combination, Java, C, C++, C #, Objective C, Fortran, Pascal, Java Script, Python, Perl, and PL/SQL.

Upon execution by processor 12, the computer-executable instructions of the DFT software module 18 may cause the computing platform 10 to implement one or more of the DFT algorithms and/or methodologies disclosed herein. Non-volatile storage 16 may also include DFT data 20 supporting the functions, features, calculations, and processes of the one or more embodiments described herein.

The program code embodying the algorithms and/or methodologies described herein is capable of being individually or collectively distributed as a program product in a variety of different forms. The program code may be distributed using a computer readable storage medium having computer readable program instructions thereon for causing a processor to carry out aspects of one or more embodiments. Computer readable storage media, which is inherently non-transitory, may include volatile and non-volatile, and removable and non-removable tangible media implemented in any method or technology for storage of information, such as computer-readable instructions, data structures, program modules, or other data. Computer readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store the desired information and which can be read by a computer.

Computer readable program instructions may be downloaded to a computer, another type of programmable data processing apparatus, or another device from a computer readable storage medium or to an external computer or external storage device via a network.

Computer readable program instructions stored in a computer readable medium may be used to direct a computer, other types of programmable data processing apparatus, or other devices to function in a particular manner, such that the instructions stored in the computer readable medium produce an article of manufacture including instructions that implement the functions, acts, and/or operations specified in the flowcharts or diagrams. In certain alternative embodiments, the functions, acts, and/or operations specified in the flowcharts and diagrams may be re-ordered, processed serially, and/or processed concurrently consistent with one or more embodiments. Moreover, any of the flowcharts and/or diagrams may include more or fewer nodes or blocks than those illustrated consistent with one or more embodiments.

Figure 2B:
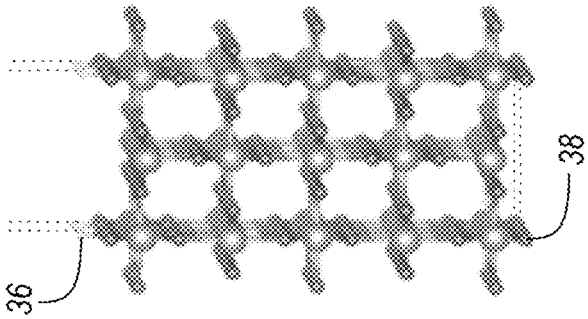
FIG. 2*b* is a schematic view depicting an adsorbate (e.g. H or O) on a DFT slab model of (110) $SnO_2$.
Figure 2A:
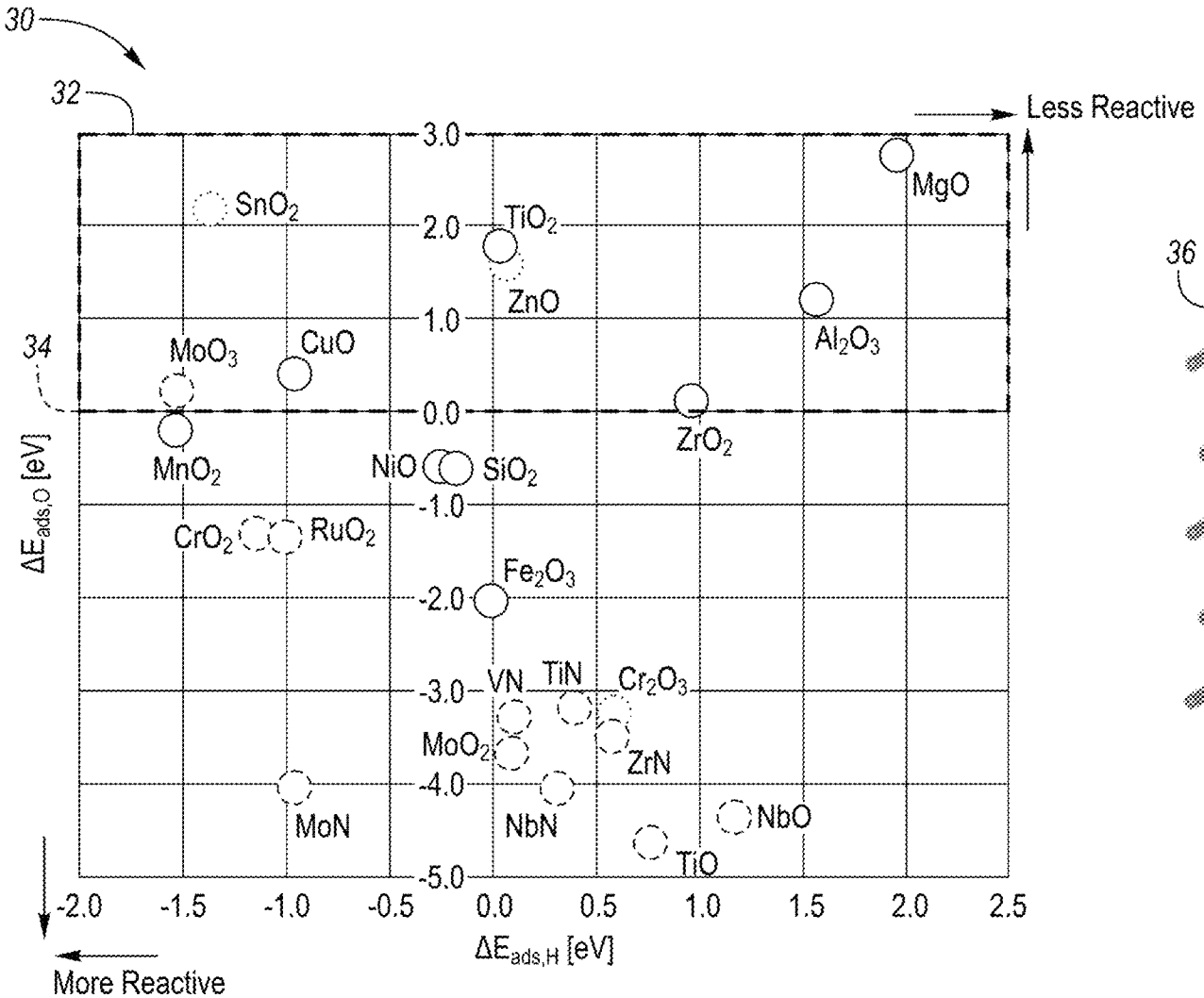
FIG. 2*a* is a graph showing DFT-based single atom adsorption energy calculations for a selection of binary oxides and nitrides.

FIG. 2*a* is graph 30 showing DFT-based single atom adsorption energy calculations for a collection of binary oxides and nitrides. Y axis 32 of graph 30 shows an oxygen binding energy ($\Delta E_{ads,O}$ [eV]) measuring the reactivity of a chemical compound (e.g. a binary oxide or nitride) against oxidation. X axis 34 of graph 30 shows a hydrogen binding energy ($\Delta E_{ads,H}$ [eV]), which is of interest because $H_2O_2$ is also a weak acid. More protective (e.g. less reactive) materials against $H_2O_2$ are located near the upper right corner of graph 30. Less protective (e.g. more reactive) materials against $H_2O_2$ are located near the lower left corner of graph 30.

Electrical conductivity may be another parameter in identifying suitable metal materials. Accordingly, FIG. 2*a* classifies each of the materials considered as conducting, intermediate or insulating based on experimentally reported electrical conductivity values. As shown in FIG. 2*a*, $MoO_3$, $CrO_2$, $RuO_2$, TiN, VN, $MoO_2$, MoN, NbN, ZrN, NbO and TiO are considered conducting compounds having an $O(10^2 \sim 10^7)$ [S/m]. $SnO_2$, ZnO and $Cr_2O_3$ are considered intermediate (e.g. semiconductor) compounds having an $O(10^{-5} \sim 10^1)$ [S/m]. MgO, $Al_2O_3$, $TiO_2$, CuO, $MnO_2$, NiO, $SiO_2$, $ZrO_2$ and $Fe_2O_3$ are considered insulating compounds having an $O(10^{-13} \sim 10^{-6})$ [S/m]. In embodiments where relatively high electrical conductivity is beneficial in addition to $H_2O_2$ chemical resistivity, FIG. 2*a* may be used to evaluate expected performance of such materials. FIG. 2*b* is a schematic view depicting adsorbate 36 (e.g. H or O) on slab model 38 of (110) $SnO_2$. Slab model 38 of (110) $SnO_2$ depicts how adsorbate 36 (e.g. H or O) adsorption is being carried out using DFT calculations.

When the binding energy (Eads) of the adsorbate is relatively more negative, the corresponding reaction between the adsorbate and a bulk metal material happens more spontaneously because the adsorbate is more reactive. In one or more embodiments, metal materials and metal material systems are examined where $E_{ads,O}$ and $E_{ads,H}$ have relatively more positive values. As shown in FIG. 2*a*, MgO, $Al_2O_3$, $ZrO_2$, $TiO_2$, and ZnO may fall into this category. In other embodiments, metal materials and metal material systems are examined where $E_{ads,O}$ is maximized because $H_2O_2$ is a strong oxidizer and $E_{ads,H}$ is considered as a secondary factor because $H_2O_2$ is a weak acid. As shown in FIG. 2*a*, $SnO_2$, CuO, and $MoO_3$ may fall into this category. In one or more embodiments, chemical systems of the Zn—Sn—Mo—Mg—Ti—Al—Zr—Cu space are examined using a data-driven materials screening approach as described below.

Figure 3A:
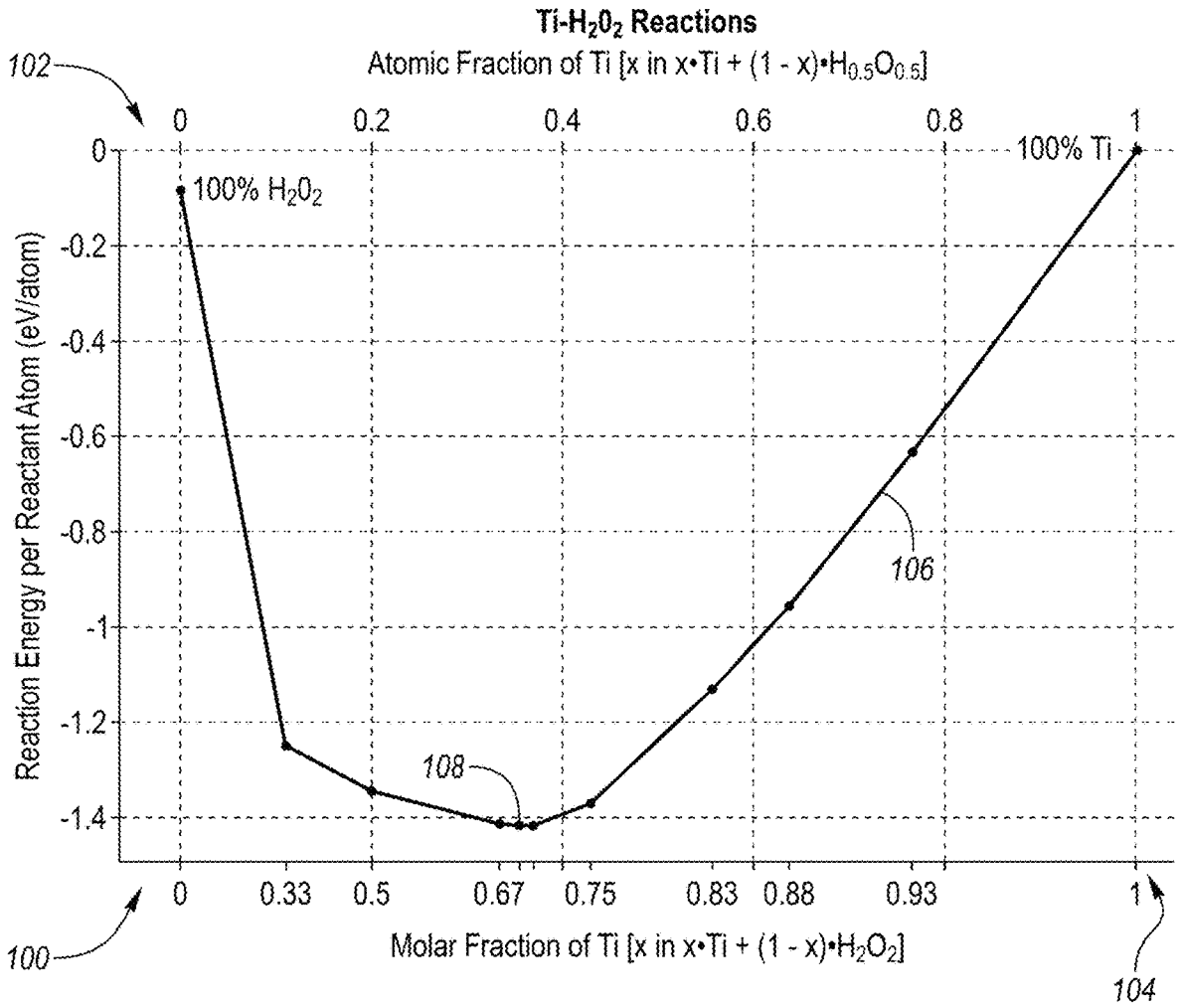
FIG. 3*a* depicts a two-dimensional convex hull diagram of reactions between Ti and $H_2O_2$.

FIG. 3*a* depicts two-dimensional convex hull diagram 100 of reactions between Ti and $H_2O_2$. Y axis 102 of two-dimensional convex hull diagram 100 represents reaction energy per reactant atom (eV/atom). X axis 104 of two-dimensional convex hull diagram 100 represents molar fraction of Ti [x in $x \cdot Ti + (1-x) \cdot H_2O_2$]. Accordingly, two-dimensional convex hull diagram 100 plots reaction energy per reactant atom (eV/atom) as a function of molar fraction of Ti [x in $x \cdot Ti + (1-x) \cdot H_2O_2$], as represented by curve 106. Based on the assumption that abundant amounts of Ti and $H_2O_2$ exist, the most stable reaction is likely to take pace at the minimum value reaction energy ($E_{rxn}$) per reactant atom. In the case of the Ti and $H_2O_2$ reaction shown in FIG. 3*a* and this assumption, the most stable reaction happens when the molar fraction (x) of Ti is at 0.7 as shown in reaction (4) below:

$$0.7Ti + 0.3H_2O_2 \rightarrow 0.2Ti_2O_3 + 0.3TiH_2 \quad (4)$$

This reaction has an $E_{Rxn}$ value of −1.419 eV/atom as shown at minimum value 108 on FIG. 3*a*. Another reaction may take place between Ti and $H_2O_2$ within the two-dimensional convex hull, as shown by reaction (5) below:

$$0.688Ti + 0.312H_2O_2 \rightarrow 0.125Ti_3O_5 + 0.312TiH_2 \quad (5)$$

This reaction has an $E_{Rxn}$ value of −1.419 eV/atom. Since $Ti_2O_3$, $Ti_3O_5$, and $TiH_2$ reacting with $H_2O_2$ eventually oxidizes to $TiO_2$, the evaluation process considers the same reaction of $TiO_2$ and $H_2O_2$ as shown in FIG. 3*b*.

Figure 3B:
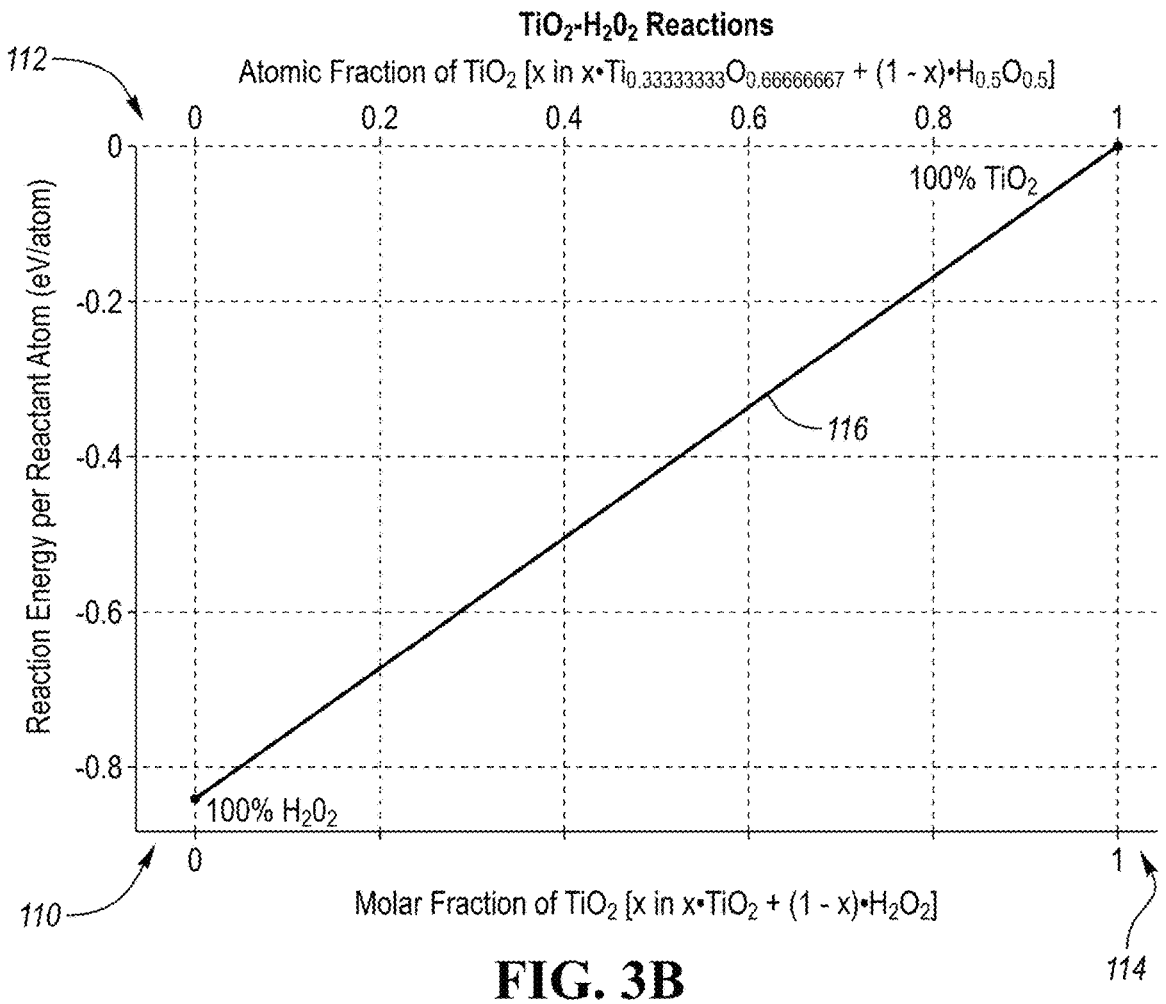
FIG. 3*b* depicts a two-dimensional convex hull diagram of reactions between $TiO_2$ and $H_2O_2$.

FIG. 3*b* depicts two-dimensional convex hull diagram 110 of reactions between $TiO_2$ and $H_2O_2$. Y axis 112 of two-dimensional convex hull diagram 110 represents reaction energy per reactant atom (eV/atom). X axis 114 of two-dimensional convex hull graph 110 represents molar fraction of $TiO_2$ [x in $x \cdot TiO_2 + (1-x) \cdot H_2O_2$]. Accordingly, two-dimensional convex hull diagram 110 plots reaction energy per reactant atom (eV/atom) as a function of molar fraction of $TiO_2$ [x in $x \cdot TiO_2 + (1-x) \cdot H_2O_2$], as represented as line 116. According to FIG. 3*b*, no reaction happens between $TiO_2$ and $H_2O_2$ as observed by the straight-line relationship between the reactants.

In one or more embodiments, the data driven approach used on FIGS. 3*a* and 3*b* is utilized to examine $H_2O_2$ reactivity against pure metals, binary oxides, ternary oxides and Ti intermetallic compounds within the Zn—Sn—Mo—Mg—Ti—Al—Zr—Cu chemical space as identified by DFT slab analysis to identify chemically-resistant metal materials against $H_2O_2$ decomposition.

Using the data-driven approach of FIGS. 3*a* and 3*b*, the metal reactivity with $H_2O_2$ is examined. The reaction enthalpy ($\Delta E_{Rxn}$) of Zn, Sn, Mo, Mg, Ti, Al, Zr, and Cu is examined in Table 1 as shown below. As shown in connection with FIGS. 3*a* and 3*b*, Ti metal reacting with $H_2O_2$ leads to $Ti_2O_3$ and $TiH_2$ formation with $\Delta E_{Rxn}$ equaling −1.419 eV/atom. When $Ti_2O_3$ and $TiH_2$ with $H_2O_2$ is further reacted with $H_2O_2$, $TiO_2$ is formed. As shown in FIG. 3*b*, no reaction takes place between $H_2O_2$ and $TiO_2$. As shown in Table 1, Sn, Mo, Zn, Cu, and Zr may be favorably comparable to Ti. Zr may be more reactive than Ti based on the $\Delta E_{rxn}$ being slightly more negative (−1.605 eV/atom) than Ti. Other metals such as Sn, Mo, Zn and Cu are less reactive when compared to Ti based on the calculated $\Delta E_{Rxn}$ provided in Table 1. For Sn, Mo, Zn, Cu, and Zr, the most stable decomposition reactions involve more $H_2O_2$ per element (between 0.5 and 2) as compared to Ti (0.43). In the case of Ti, 0.3 mol of $H_2O_2$ reacts with 0.7 mol of Ti (i.e. $0.3H_2O_2$ divided by 0.7Ti equals 0.43). The intermediate and final products when Sn, Mo, Zn, Cu, and Zr react with $H_2O_2$ do not lead to gas evolution (e.g. $H_2$ or $O_2$ evolution) according to Table 1. Moreover, according to Table 1, the last reaction product of Sn, Mo, Zn, Cu, and Zr (i.e. $SnO_2$, $MoO_3$, $Zn(OH)_2$, $Cu_2O_3$ and $ZrO_2$, respectively) do not react with $H_2O_2$. Table 1 shows that Mg and Al lead to $H_2$ evolution and MgO and $Al_2O_3$ leads to $O_2$ evolution when reacting with $H_2O_2$. In summary, our analysis shows that Sn, Mo, Zn, Cu, and Zr would be comparable or better than protective Ti metals, while Mg and Al may be less desirable against $H_2O_2$ decomposition because of $H_2$ gas evolution.

TABLE 1

| Class | Element | Reaction | $H_2O_2$/ element | $\Delta E_{Rxn}$ [eV/atom] | Notes |
|---|---|---|---|---|---|
| Protective | Sn | 0.667 $H_2O_2$ + 0.333 Sn 0.667 $H_2O$ + 0.333 $SnO_2$ | 2 | −0.785 | $SnO_2$ does not react with $H_2O_2$ |
| | Mo | .667 $H_2O_2$ + 0.333 Mo → 0.667 $H_2O$ + 0.333 $MoO_2$ | 2 | −0.789 | $MoO_2$ reacting with $H_2O_2$ forms $MoO_3$, where $MoO_3$ does not react with $H_2O_2$ |
| | Zn | 0.5 $H_2O_2$ + 0.5 Zn → 0.5 $Zn(OH)_2$ | 1 | −0.790 | $Zn(OH)_2$ does not react with $H_2O_2$ |
| | Cu | 0.5 $H_2O_2$ + 0.5 Cu → 0.5 $H_2O$ + 0.5 CuO | 1 | −0.449 | CuO reacting with $H_2O_2$ becomes $Cu_2O_3$, where $Cu_2O_3$ will not react with $H_2O_2$ |
| | Zr | 0.333 $H_2O_2$ + 0.667 Zr → 0.333 $ZrO_2$ + 0.333 $ZrH_2$ | 0.5 | −1.605 | $ZrH_2$ reacting with $H_2O_2$ becomes $ZrO_2$, where $ZrO_2$ does not react with $H_2O_2$ |
| | Ti | 0.3 $H_2O_2$ + 0.7 Ti → 0.2 $Ti_2O_3$ + 0.3 $TiH_2$ | 0.43 | −1.419 | $Ti_2O_3$ & $TiH_2$ reacting with $H_2O_2$ becomes $TiO_2$, where $TiO_2$ does not react with $H_2O_2$ |
| Not protective | Mg | 0.333 $H_2O_2$ + 0.667 Mg → 0.667 MgO + 0.333 $H_2$ | 0.5 | −1.405 | MgO reacting with reacting with $H_2O_2$ leads to gas evolution of $O_2$↑ |
| | Al | 0.429 $H_2O_2$ + 0.571 Al → 0.286 $Al_2O_3$ + 0.429 $H_2$ | 0.75 | −1.434 | $Al_2O_3$ reacting with reacting with $H_2O_2$ leads to gas evolution of $O_2$↑ |

In one or more embodiments, a data-driven analysis is utilized to examine binary oxide reactivity against $H_2O_2$. Binary metal oxide reactivity with $H_2O_2$ is examined in Table 2 below. As described above in connection with Table 1, once MgO and $Al_2O_3$ reacts with $H_2O_2$, undesirable $O_2$ gas evolution happens. While a pure Zn metal is predicted to produce $Zn(OH)_2$ unreactive with $H_2O_2$ as set forth in Table 1, the reaction between ZnO and $H_2O_2$ leads to undesirable $O_2$ evolution as shown in Table 2. In contrast, Table 2 indicates that the following binary oxides may not react with $H_2O_2$: $SnO_2$, $MoO_3$, $Cu_2O_3$, $ZrO_2$, and $TiO_2$. In light of this analysis, Sn, Mo, Cu, Zr, and Ti metals may be beneficial against for $H_2O_2$ protection in one or more embodiments. In one or more embodiments, $SnO_2$, $MoO_3$, $Cu_2O_3$, $ZrO_2$, and $TiO_2$ may be used as protective oxide coatings on the target substrate (e.g., metal, semiconductor, oxide, etc.).

Because $Cu_2O_3$ is metallic (e.g. the bandgap ($E_g$) equals 0 eV), it may be useful for applications that require electrical conductance. $SnO_2$, $MoO_3$, $ZrO_2$, and $TiO_2$ are not metallic (e.g. bandgap ($E_g$) does not equal 0). Regarding these binary metal oxides, adding one or more cation and/or anion dopants and/or vacancy may further tune the electrical conductivity. The cation dopant in a $MO_x$ metal oxide may be Al, Ce, Co, Cr, Eu, Fe, Ga, Gd, Mn, Nb, Pr, Sb, Sc, Sm, Ti, V, Y, Yb, or a combination thereof. The one or more cation dopants may substitute about 0, 2, 4, 6, 8, 10, 12, 14, 16, 18, 20, 22, 24, 26, 28, 30, 32, 34, 36, 38, 40, 42, 44, 46, 48, or 50% of M sites in a $MO_x$ metal oxide. The cation doping concentration may be about, at least about, no more about, or at most about 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16,16.5, 17, 17.5, 18, 18.5, 19, 19.5, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 mol % in M sites in a $MO_x$ metal oxide. The anion dopant may be N, C, F, S, Cl or combinations thereof. The anion dopant concentration may be about, at least about, no more about, or at most about 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, or 10 mol % in substitution for 0 in a $MO_x$ metal oxide. Vacancies may be oxygen vacancies signified by δ in the chemical formula $MO_{3-\delta}$ or $MO_{2-\delta}$. δ may be any number between about 0.0 and 0.5 optionally including a fractional part denoting the oxygen vacancies. δ may be about 0.0, 0.1, 0.15, 0.2, 0.25, 0.3, 0.35, 0.4, 0.45, 0.5, or a range including any two of the disclosed numerals.

For example, oxygen deficient $MoO_2$, CuO, TiO, and $Ti_2O_3$ are examined in Table 2. Generally, these species are predicted to convert to their fully oxidized version when reacting with $H_2O_2$. The corresponding reaction enthalpy may differ, where Table 2 shows that CuO→$Cu_2O_3$ is least favorable ($\Delta E_{rxn}$ equals −0.094 eV/atom) and TiO→$TiO_2$ is most favorable ($\Delta E_{rxn}$ equals −0.843 eV/atom).

In one or more embodiments, the use of Sn, Mo, Cu, or Zr metals that may naturally form their binary metal oxide at the surface are desirable for $H_2O_2$ protection, comparable to Ti metal. However, as shown in Table 2, Zn, Mg, and Al may lead to metal oxides that can further lead to $O_2$ gas evolution. In one or more embodiments, protective binary oxides such as $SnO_2$, $MoO_3$, $ZrO_2$, and $TiO_2$ may be used as protective coatings in given substrate materials. In one or more embodiments, cation and/or anion doping and/or oxygen-deficient species (e.g. $MoO_{3-\delta}$, $Cu_2O_{3-\delta}$, $TiO_{2-\delta}$) may be used to increase electrical conductivity. The cation dopant in a $MO_x$ metal oxide may be Al, Ce, Co, Cr, Eu, Fe, Ga, Gd, Mn, Nb, Pr, Sb, Sc, Sm, Ti, V, Y, Yb, or a combination thereof. The one or more cation dopants may substitute about 0, 2, 4, 6, 8, 10, 12, 14, 16, 18, 20, 22, 24, 26, 28, 30, 32, 34, 36, 38, 40, 42, 44, 46, 48, or 50% of M sites in a $MO_x$ metal oxide. The cation doping concentration may be about, at least about, no more about, or at most about 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 mol % in M sites in a $MO_x$ metal oxide. The anion dopant may be N, C, F, S, Cl or combinations thereof. The anion dopant concentration may be about, at least about, no more about, or at most about 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, or 10 mol % in substitution for 0 in a $MO_x$ metal oxide. Vacancies may be oxygen vacancies signified by δ in the chemical formula $MO_{3-\delta}$ or $MO_{2-\delta}$. δ may be any number between about 0.0 and 0.5 optionally including a fractional part denoting the oxygen vacancies. δ may be about 0.0, 0.1, 0.15, 0.2, 0.25, 0.3, 0.35, 0.4, 0.45, 0.5, or a range including any two of the disclosed numerals.

Materials with higher electrical conductivity can help design a thicker protective layer for applications that call for a high electrical conductance, such as the metal surfaces of dishwashers. In embodiments that materials do not have high electrical conductance, the thickness of the protective layer may be any of the following values or in a range of any two of the following values: 1, 2, 3, 4, 5, 10, 15, 20, 25, 30, 35, 40, 45, 50, 55, 60, 65, 70, 75, 80, 85, 90, 95, or 100 nm. In embodiments that call for high electrical conductance (e.g. an electrochemical cell in a dishwasher), the thickness of the protective layer may be any of the following values or in a range of any two of the following values, if made of materials with high electrical conductance: 500, 525, 550, 575, 600, 625, 650, 675, 700, 725, 750, 775, 800, 825, 850, 875, 900, 925, 950, 975 and 1,000 nm. In Table 2, the unit for $E_g$ is eV, and the unit for JE, is eV/atom. In Table 2, "$H_2O_2$ per" refers to $H_2O_2$ per compound.

TABLE 2

| Class | Oxides | $E_g$ | Reaction | $H_2O_2$ Per | $\Delta E_{Rxn}$ | Notes |
|---|---|---|---|---|---|---|
| Protective | $SnO_2$ | 0.652 | No Reaction | N/A | N/A | Desirable |
| | $MoO_2$ | 0.000 | 0.5 $H_2O_2$ + 0.5 $MoO_2$ → 0.5 $MoO_3$ + 0.5 $H_2O$ | 1 | −0.289 | $MoO_2$ reacting with $H_2O_2$ forming $MoO_3$ |
| | $MoO_3$ | 1.372 | No Reaction | N/A | N/A | Desirable |
| | CuO | 0.000 | 0.333 $H_2O_2$ + 0.667 CuO → 0.333 $Cu_2O_3$ + 0.333 $H_2O$ | 0.5 | −0.094 | CuO reacting with $H_2O_2$ forming $Cu_2O_3$ |
| | $Cu_2O_3$ | 0.000 | No Reaction | N/A | N/A | Desirable |
| | $ZrO_2$ | 3.474 | No Reaction | N/A | N/A | Desirable |
| | TiO | 0.000 | 0.5 $H_2O_2$ + 0.5 TiO → 0.5 $H_2O$ + 0.5 $TiO_2$ | 1 | −0.843 | TiO reacting with $H_2O_2$ forming $TiO_2$ |
| | $Ti_2O_3$ | 0.000 | 0.5 $H_2O_2$ + 0.5 $Ti_2O_3$ → 0.5 $H_2O$ + $TiO_2$ | 1 | −0.540 | $Ti_2O_3$ reacting with $H_2O_2$ forming $TiO_2$ |
| | $Ti_3O_5$ | 0.000 | 0.5 $H_2O_2$ + 0.5 $Ti_3O_5$ → 0.5 $H_2O$ + 1.5 $TiO_2$ | 1 | −0.402 | $Ti_3O_5$ reacting with $H_2O_2$ forming $TiO_2$ |
| | $TiO_2$ | 2.679 | No Reaction | N/A | N/A | Desirable |
| Not protective | ZnO | 0.732 | 0.5 $H_2O_2$ + 0.5 ZnO → 0.5 $Zn(OH)_2$ + 0.25 $O_2$ | 1 | −0.058 | $Zn(OH)_2$ does not react with $H_2O_2$ |
| | MgO | 4.445 | 0.5 $H_2O_2$ + 0.5 MgO → 0.5 $Mg(OH)_2$ + 0.25 $O_2$ | 1 | −0.071 | $Mg(OH)_2$ does not react with $H_2O_2$ |
| | $Al_2O_3$ | 5.854 | 0.5 $H_2O_2$ + 0.5 $Al_2O_3$ → $AlHO_2$ + 0.25 $O_2$ | 1 | −0.057 | $AlHO_2$ does not react with $H_2O_2$ |

In one or more embodiments, $H_2O_2$ reactivity against "stable" ternary oxide compounds in the Zn—Sn—Mo—Mg—Ti—Al—Zr—Cu chemical space. For purposes of these embodiments, a "stable" compound refers to a compound that has a zero convex hull distance ($E_{hull}$) at the given chemical system. Moreover, the stable phase may be experimentally synthesized and does not decompose to other stable phase mixtures in a closed system. In Table 3 below, $Zn(CuO_2)_2$ and $TiSnO_3$ may be desirable in environments including $H_2O_2$ and are considered Tier 1 ternary oxides. $Zn(CuO_2)_2$ has a low band gap (~0.4 eV) and it does not react against $H_2O_2$. $TiSnO_3$ also has a relatively low band gap (~1 eV), and when it reacts with $H_2O_2$, the resulting products (i.e., $SnO_2$ and $TiO_2$) do not react with $H_2O_2$. In one or more embodiments, Zn—Cu and/or Ti—Sn alloys may also be used. Table 3 also includes the following Tier 2 ternary oxides: $Ti_3Zn_2O_8$, $MoZnO_4$, $Al_2ZnO_4$, $Zr(MoO_4)_2$, $MgMo_2O_7$, and $Al_2(MoO_4)_3$. These compounds do not react with $H_2O_2$ and their bandgaps are quite high (2.5 to 3.7 eV). These compounds may be modified using cation-substitution and/or crating oxygen-deficient species (e.g. $MoO_{3-x}$, $Cu_2O_{3-x}$, $TiO_{2-x}$) to increase electrical conductivity. Table 3 also shows that $Zn(MoO_2)_2$ and $Mg(MoO_2)_2$ further decompose to Tier 2 ternary oxide when reacting with $H_2O_2$. $Mg_2SnO_4$ and $MgMoO_4$ both lead to $O_2$ gas evolution when reacting with $H_2O_2$. Therefore, these ternary oxides are not recommended for application with metal materials in a peroxide environment according to one or more embodiments. In Table 3, the unit for $E_g$ is eV, and the unit for $\Delta E_{Rxn}$ is eV/atom. In Table 3, "$H_2O_2$ per" refers to $H_2O_2$ per compound. In Table 3, "NP" stands for "Not Protective".

TABLE 3

| Class | Oxides | $E_g$ | Reaction | $H_2O_2$ per | $\Delta E_{Rxn}$ | Notes |
|---|---|---|---|---|---|---|
| Tier 1 | $Zn(CuO_2)_2$ | 0.414 | No Reaction | N/A | N/A | Top candidate |
| | $TiSnO_3$ | 1.102 | 0.5 $H_2O_2$ + 0.5 $TiSnO_3$ → 0.5 $TiO_2$ + 0.5 $SnO_2$ + 0.5 $H_2O$ | 1 | −0.380 | Insulating |
| Tier 2 | $Ti_3Zn_2O_8$ | 2.587 | No Reaction | N/A | N/A | Insulating |
| | $MoZnO_4$ | 3.538 | No Reaction | N/A | N/A | Insulating |
| | $Al_2ZnO_4$ | 3.847 | No Reaction | N/A | N/A | Insulating |
| | $Zr(MoO_4)_2$ | 3.116 | No Reaction | N/A | N/A | Insulating |
| | $MgMo_2O_7$ | 3.674 | No Reaction | N/A | N/A | Insulating |
| | $Al_2(MoO_4)_3$ | 3.759 | No Reaction | N/A | N/A | Insulating |
| Tier 3 | $Zn(MoO_2)_2$ | 2.233 | 0.75 $H_2O_2$ + 0.25 $Zn(MoO_2)_2$ → 0.25 $MoZnO_4$ + 0.25 $MoO_3$ + 0.75 $H_2O$ | 3 | −0.393 | $MoZnO_4$ & $MoO_3$ (protective) |
| | $Mg(MoO_2)_2$ | 2.886 | 0.75 $H_2O_2$ + 0.25 $Mg(MoO_2)_2$ → 0.25 $MgMo_2O_7$ + 0.75 $H_2O$ | 1 | −0.420 | $MgMo_2O_7$ (protective) |
| NP | $Mg_2SnO_4$ | 2.534 | 0.667 $H_2O_2$ + 0.333 $Mg_2SnO_4$ → 0.667 $Mg(OH)_2$ + 0.333 $SnO_2$ + 0.333 $O_2$ | 2 | −0.046 | $Mg(OH)_2$ & $SnO_2$ (protective) |
| | $MgMoO_4$ | 3.785 | 0.5 $H_2O_2$ + 0.5 MgMoO4 → 0.5 $MgMoH_2O_5$ + 0.25 $O_2$ | 1 | −0.034 | $MgMoH_2O_5$ (protective) |

In one or more embodiments, ternary oxide compounds having a convex hull distance of less than 25 meV/atom are examined. These ternary oxide compounds may be referred to as "nearly-stable" according to one or more embodiments. Many of these "nearly-stable" compounds may be synthesized and observed in nature, but there are more stable phase mixtures at the given chemical composition. Table 4 shows $H_2O_2$ reactivity with "nearly-stable" ternary compounds in the Zn—Sn—Mo—Mg—Ti—Al—Zr—Cu chemical space. Of the "nearly-stable" ternary compounds examined, $TiSn_9O_{20}$ is desirable because it has no reaction against $H_2O_2$ with a moderate $E_g$ (~1 eV) and is considered a Tier 1 "nearly-stable" ternary compound. Table 2 also depicts the following Tier 2 compounds as follows: $Cu_6SnO_8$, $Cu_3Mo_2O_9$, $CuMoO_4$, $Cu_3(MoO_3)_4$, $Zr_5Sn_3O$ and $Ti(SnO_2)_2$. These Tier 2 compounds form protective binary oxides after reacting with $H_2O_2$ as shown in Table 4. Table 4 also shows that $Zn_2SnO_4$, $Zn_3Mo_2O_9$, $MgZn_7O_8$, $MgZn_4O_5$, $MgZn_3O_4$, $MgSnO_3$, and $Al_{10}ZnO_{16}$ are not desirable due to $O_2$ gas evolution when reacting with $H_2O_2$. In Table 4, the unit for $E_{hull}$ is eV/atom, the unit for $E_g$ is eV, and the unit for $\Delta E_{Rxn}$ is eV/atom. In Table 4, $H_2O_2$ per refers to $H_2O_2$ per compound. In Table 4, "NP" stands for "Not Protective".

TABLE 4

| Class | Oxides | $E_{hull}$ | $E_g$ | Reaction | $H_2O_2$ per | $\Delta E_{Rxn}$ | Notes |
|---|---|---|---|---|---|---|---|
| Tier 1 | $TiSn_9O_{20}$ | 0.014 | 1.126 | No Reaction | N/A | N/A | Top candidate |
| Tier 2 | $Cu_6SnO_8$ | 0.013 | 0.000 | 0.75 $H_2O_2$ + 0.25 $Cu_6SnO_8$ → 0.75 $Cu_2O_3$ + 0.25 $SnO_2$ + 0.75 $H_2O$ | 3 | −0.091 | $Cu_2O_3$, $SnO_2$ (protective) |
| | $Cu_3Mo_2O_9$ | 0.022 | 0.346 | 0.6 $H_2O_2$ + 0.4 $Cu_3Mo_2O_9$ 0.6 $Cu_2O_3$ + 0.8 $MoO_3$ + 0.6 $H_2O$ | 1.5 | −0.072 | $Cu_2O_3$, $MoO_3$ (protective) |
| | $CuMoO_4$ | 0.024 | 0.346 | 0.333 $H_2O_2$ + 0.667 $CuMoO_4$ → 0.333 $Cu_2O_3$ + 0.667 $MoO_3$ + 0.333 $H_2O$ | 2 | −0.065 | $Cu_2O_3$, $MoO_3$ (protective) |
| | $Cu_3(MoO_3)_4$ | 0.013 | 0.503 | 0.75 $H_2O_2$ + 0.25 $Cu_3(MoO_3)_4$ → $MoO_3$ + 0.75 CuO + 0.75 $H_2O$ | 3 | −0.203 | $MoO_3$ (protective); CuO → $Cu_2O_3$ |
| | $Zr_5Sn_3O$ | 0.004 | 0.000 | 0.9 $H_2O_2$ + 0.1 $Zr_5Sn_3O$ → 0.5 $ZrO_2$ + 0.3 Sn + 0.9 $H_2O$ | 9 | −1.124 | Sn, $ZrO_2$ (protective) |
| | $Ti(SnO_2)_2$ | 0.001 | 1.084 | 0.667 $H_2O_2$ + 0.333 $Ti(SnO_2)_2$ → 0.333 $TiO_2$ + 0.667 $SnO_2$ + 0.667 $H_2O$ | 2 | −0.457 | $TiO_2$, $SnO_2$ (protective) |
| NP | $Zn_2SnO_4$ | 0.017 | 0.825 | 0.333 $Zn_2SnO_4$ + 0.667 $H_2O_2$ → 0.667 $Zn(HO)_2$ + 0.333 $SnO_2$ + 0.333 $O_2$ | 2 | −0.054 | Not desirable due to $O_2$ evolution |
| | $Zn_3Mo_2O_9$ | 0.010 | 3.160 | 0.5 $Zn_3Mo_2O_9$ + 0.5 $H_2O_2$ $ZnMoO_4$ + 0.5 $Zn(HO)_2$ + 0.25 $O_2$ | 1 | −0.027 | |

TABLE 4-continued

| Class | Oxides | $E_{hull}$ | $E_g$ | Reaction | $H_2O_2$ per | $\Delta E_{Rxn}$ | Notes |
|---|---|---|---|---|---|---|---|
| | $MgZn_7O_8$ | 0.006 | 1.014 | 0.889 $H_2O_2$ + 0.111 $MgZn_7O_8$ → 0.778 $Zn(HO)_2$ + 0.111 $Mg(HO)_2$ + 0.444 $O_2$ | 8 | −0.062 | |
| | $MgZn_4O_5$ | 0.013 | 0.971 | 0.833 $H_2O_2$ + 0.167 $MgZn_4O_5$ → 0.667 $Zn(HO)_2$ + 0.167 $Mg(HO)_2$ + 0.417 $O_2$ | 5 | −0.065 | |
| | $MgZn_3O_4$ | 0.013 | 1.269 | 0.5 $H_2O_2$ + 0.5 $MgZn_2O_3$ → 0.5 $Mg(HO)_2$ + 0.25 $O_2$ + ZnO | 1 | −0.100 | |
| | $MgSnO_3$ | 0.003 | 2.559 | 0.5 $H_2O_2$ + 0.5 $MgSnO_3$ → 0.5 $Mg(HO)_2$ + 0.5 $SnO_2$ + 0.25 $O_2$ | 1 | −0.040 | |
| | $Al_{10}ZnO_{16}$ | 0.021 | 4.243 | 0.8 $H_2O_2$ + 0.2 $Al_{10}ZnO_{16}$ 1.6 $AlHO_2$ + 0.2 $Al_2ZnO_4$ + 0.4 $O_2$ | 3 | −0.061 | |

In one or more embodiments, Ti-M intermetallic compounds having a zero bandgap are examined. These Ti-M intermetallic compounds may be an acceptable substitute for pure Ti where high purity Ti metal is too expensive for certain applications. In Table 5 below, $Ti_5Sn_3$, $Ti_6Sn_5$, $Ti_2Sn_3$, $TiMo_3$, TiZn, $TiCu_4$, $Ti_3Cu_4$, and TiCu reacting with $H_2O_2$ lead to protective species and are considered Tier 1 intermetallic compounds. Table 5 also includes the following Tier 2 intermetallic compounds: $TiZn_3$, $Ti_3Zn_{22}$, and $TiZn_2$. These compounds lead to the formation of $Ti_3Zn_2O_8$. According to Table 3, $Ti_3Zn_2O_8$ is classified as a Tier 2 stable ternary oxide with a high bandgap that does not react with $H_2O_2$. Table 5 also shows that certain Ti—Al intermetallic compounds may be not desirable because these compounds may form $Al_2O_3$ when reacting with $H_2O_2$, which leads to $O_2$ gas evolution in contact with $H_2O_2$. $Ti_3Sn$, $Ti_2Sn$, $Ti_2Zn$, and $Ti_2Cu$ may not be desirable due to $H_2$ gas evolution. In Table 5, the unit for $\Delta E_{Rxn}$ is eV/atom. In Table 5, $H_2O_2$ per refers to $H_2O_2$ per compound. In Table 5, "NP" stands for "Not Protective".

TABLE 5

| Class | Intermetallic | Reaction | $H_2O_2$ per | $\Delta E_{Rxn}$ | Notes |
|---|---|---|---|---|---|
| Protective | $Ti_5Sn_3$ | 0.909 $H_2O_2$ + 0.091 $Ti_5Sn_3$ → 0.455 $TiO_2$ + 0.909 $H_2O$ + 0.273 Sn | 9.99 | −1.114 | $TiO_2$ & Sn (protective) |
| | $Ti_6Sn_5$ | 0.923 $H_2O_2$ + 0.077 $Ti_6Sn_5$ → 0.462 $TiO_2$ + 0.923 $H_2O$ + 0.385 Sn | 11.99 | −1.075 | |
| | $Ti_2Sn_3$ | 0.2 $Ti_2Sn_3$ + 0.8 $H_2O_2$ → 0.4 $TiO_2$ + 0.8 $H_2O$ + 0.6 Sn | 4 | −0.998 | |
| | $TiMo_3$ | 0.333 $TiMo_3$ + 0.667 $H_2O_2$ → 0.333 $TiO_2$ + 0.667 $H_2O$ + Mo | 2 | −0.892 | $TiO_2$ & Mo (protective) |
| | TiZn | 0.667 $H_2O_2$ + 0.333 TiZn → 0.333 $TiO_2$ + 0.667 $H_2O$ + 0.333 Zn | 2 | −1.087 | $TiO_2$ & Zn (protective) |
| | $TiCu_4$ | 0.667 $H_2O_2$ + 0.333 $TiCu_4$ → 0.667 $H_2O$ + 0.333 $TiO_2$ + 1.333 Cu | 2 | −0.833 | $TiO_2$ & Cu (protective) |
| | $Ti_3Cu_4$ | 0.857 $H_2O_2$ + 0.143 $Ti_3Cu_4$ → 0.857 $H_2O$ + 0.429 $TiO_2$ + 0.571 Cu | 5.99 | −1.060 | |
| | TiCu | 0.667 $H_2O_2$ + 0.333 TiCu → 0.667 $H_2O$ + 0.333 $TiO_2$ + 0.333 Cu | 2 | −1.097 | |
| Tier 2 | $TiZn_3$ | 0.833 $H_2O_2$ + 0.167 $TiZn_3$ → 0.389 $Zn(HO)_2$ + 0.056 $Ti_3Zn_2O_8$ + 0.444 $H_2O$ | 4.99 | −0.931 | $Ti_3Zn_2O_8$ (Tier 2) |
| | $Ti_3Zn_{22}$ | 0.966 $H_2O_2$ + 0.034 $Ti_3Zn_{22}$ → 0.69 $Zn(HO)_2$ + 0.034 $Ti_3Zn_2O_8$ + 0.276 $H_2O$ | 28.4 | −0.861 | |
| | $TiZn_2$ | 0.8 $H_2O_2$ + 0.2 $TiZn_2$ → 0.267 $Zn(HO)_2$ + 0.067 $Ti_3Zn_2O_8$ + 0.533 $H_2O$ | 4 | −0.978 | |
| NP | TiAl | 0.467 $H_2O_2$ + 0.533 TiAl → 0.067 $TiO_2$ + 0.467 $TiH_2$ + 0.267 $Al_2O_3$ | 0.88 | −1.328 | $Al_2O_3$ not desirable; $O_2$↑ |
| | $Ti_3Al$ | 0.652 $H_2O_2$ + 0.348 $Ti_3Al$ → 0.391 $TiO_2$ + 0.652 $TiH_2$ + 0.174 $Al_2O_3$ | 1.87 | −1.346 | |
| | $TiAl_3$ | 0.692 $H_2O_2$ + 0.308 $TiAl_3$ → 0.308 $TiH_2$ + 0.462 $Al_2O_3$ + 0.385 $H_2$ | 2.25 | −1.336 | |
| | $TiAl_2$ | 0.6 $H_2O_2$ + 0.4 $TiAl_2$ → 0.4 $TiH_2$ + 0.4 $Al_2O_3$ + 0.2 $H_2$ | 1.5 | −1.326 | |
| | $Ti_3Sn$ | 0.25 $Ti_3Sn$ + 0.75 $H_2O_2$ → 0.75 $TiO_2$ + 0.25 Sn + 0.75 $H_2$ | 3 | −1.186 | $H_2$ evolution |

TABLE 5-continued

| Class | Intermetallic | Reaction | $H_2O_2$ per | $\Delta E_{Rxn}$ | Notes |
|---|---|---|---|---|---|
| | $Ti_2Sn$ | $0.333\ Ti_2Sn + 0.667\ H_2O_2 \rightarrow 0.667\ TiO_2 + 0.333\ Sn + 0.667\ H_2$ | 2 | −1.133 | |
| | $Ti_2Zn$ | $0.667\ H_2O_2 + 0.333\ Ti_2Zn \rightarrow 0.667\ TiO_2 + 0.333\ Zn + 0.667\ H_2$ | 2 | −1.182 | |
| | $Ti_2Cu$ | $0.667\ H_2O_2 + 0.333\ Ti_2Cu \rightarrow 0.667\ TiO_2 + 0.333\ Cu + 0.667\ H_2$ | 2 | −1.191 | |

Figure 4A:
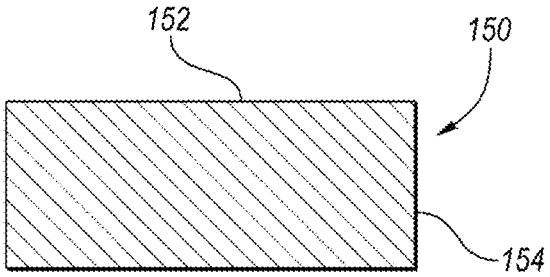
FIG. 4*a* depicts a cross section view of a metal substrate including a surface region and a bulk region according to one or more embodiments.
Figure 4B:
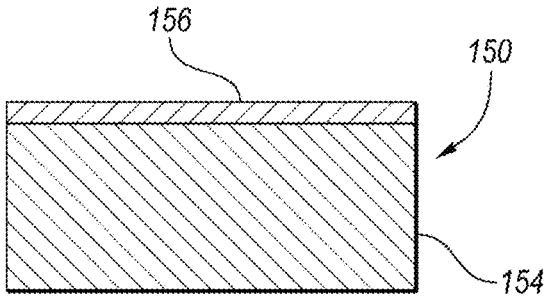
FIG. 4*b* depicts a cross section view of a metal substrate including a coating thereon according to one or more embodiments.

The metal materials identified above may be utilized as bulk materials of or coating materials on metal components in dishwashers and metal components used in other applications in which the metal components are exposed to hydrogen peroxide. FIG. 4*a* depicts a cross section view of metal substrate 150 formed of or including a metal material of one or more embodiments. The thickness of metal substrate 150 may be any of the following values or in the range of any two of the following values: 0.1 mm to 10 cm. Metal substrate 150 includes surface region 152 and bulk region 154. Metal substrate 150 may be formed of an elemental metal. In these embodiments, surface region 152 and/or bulk region 154 may include a metal hydroxide and/or a metal oxide of decomposition reaction between the elemental metal and hydrogen peroxide. The weight % of metal oxide and/or hydroxide in bulk region 154 may be any of the following values or in a range of any two of the following values: 10, 15, 20, 25, 30, 35, 40, 45 or 50 weight %. The weight % of metal hydroxide in surface region 152 may be any of the following values or in a range of any two of the following values: 25, 30, 35, 40, 45, 50, 55, 60, 65, 70, 75, 80, 85, 90, 95 or 100 weight %. In one or more embodiments, surface region 152 has a thickness in the range of less than 1 nm. FIG. 4*b* depicts a cross section view of substrate 150 including coating layer 156 thereon. In one or more embodiments, coating layer 156 has a thickness in the range of 5 nm to 1 mm. Coating layer 156 may be formed of or include a metal material disclosed in one or more embodiments herein. The one or more metal materials may have their electrical conductivity tuned by cation doping, anion doping and/or vacancy strategies as set forth above.

The surface region 152 and/or bulk region 154 may include an elemental metal having a decomposition reaction with hydrogen peroxide having a ratio of hydrogen peroxide to metal element of 0.5 to 2.0. The metal element may be configured to impart chemical resistance to peroxide degradation.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A home appliance chemically resistant to peroxide degradation, the home appliance comprising:

a metal substrate disposed within the home appliance and having a bulk portion and a surface portion, the bulk and/or surface portion including an elemental metal having a decomposition reaction with hydrogen peroxide having a ratio of hydrogen peroxide to metal element of 10:1 to 1:10, the metal element configured to impart chemical resistance to peroxide degradation.

2. The home appliance of claim 1, wherein the bulk portion includes the elemental metal, the surface portion includes a metal oxide and/or a metal hydroxide of a decomposition reaction between the elemental metal and hydrogen peroxide, and the metal hydroxide or a fully-oxidized metal oxide is unreactive with hydrogen peroxide.

3. The home appliance of claim 2, wherein the metal oxide or metal hydroxide is $Zn(OH)_2$, $Cu_2O_3$, or a combination thereof.

4. The home appliance of claim 1, wherein the elemental metal is Sn, Mo, Zn, Cu, or a combination thereof.

5. A home appliance chemically resistant to peroxide degradation, the home appliance comprising:

a metal substrate disposed within the home appliance and having a bulk portion and a coating layer contacting a surface of the bulk portion, the coating layer including a metal hydroxide and/or a metal oxide of a decomposition reaction between the elemental metal and hydrogen peroxide, and the metal hydroxide or a fully-oxidized metal oxide is unreactive with hydrogen peroxide.

6. The home appliance of claim 5, wherein the metal oxide or metal hydroxide is, $Zn(OH)_2$, $Cu_2O_3$ or a combination thereof.

7. The home appliance of claim 5, wherein the metal oxide or hydroxide has a composition having the following formula: $M(OH)_\delta$, $MO_{3-\delta}$ or $MO_{2-\delta}$, where M is an elemental metal, and where $\delta$ is any number between about 0.0 and 3.0, optionally including a fractional part denoting an oxygen vacancy for metal oxide.

8. The home appliance of claim 5, wherein the metal oxide or hydroxide has a composition having the following formula: $MXO_y$ or $MX(OH)_y$, where M is an element metal, and where X is Al, Ce, Co, Cr, Eu, Fe, Ga, Gd, Mn, Nb, Pr, Sb, Sc, Sm, Ti, V, Y, Yb, or a combination thereof.

9. The home appliance of claim 5, wherein the coating layer has a thickness in a range of 5 nm to 1 mm.

10. A home appliance chemically resistant to peroxide degradation, the home appliance comprising:

a metal substrate disposed within the home appliance and having a bulk portion and a coating layer contacting a surface of the bulk portion, the coating layer including a ternary metal oxide compound, a metal alloy, an intermetallic compound, or a combination thereof, the ternary metal oxide compound, the metal alloy or the intermetallic compound (a) unreactive with hydrogen peroxide or (b)(1) reactive with hydrogen peroxide to form one or more metal oxides unreactive with hydrogen peroxide or reactive with hydrogen peroxide to form one or more metal oxides unreactive with hydrogen peroxide and/or (b)(2) reactive with hydrogen peroxide to form one or more elemental metals reactive with hydrogen peroxide to form one or more metal oxides.

11. The home appliance of claim 10, wherein the coating layer includes a ternary metal oxide compound of $Zn(CuO_2)_2$, $TiSnO_3$ or a combination thereof.

12. The home appliance of claim 10, wherein the coating layer includes a metal alloy of a Zn—Cu metal alloy, a Ti—Sn metal alloy or a combination thereof.

13. The home appliance of claim 10, wherein the coating layer includes a ternary metal oxide compound of $Ti_3Zn_2O_8$, $MoZnO_4$, $Al_2ZnO_4$, $Zr(MoO_4)_2$, $MgMo_2O_7$, and $Al_2(MoO_4)_3$.

14. The home appliance of claim 10, wherein the coating layer includes a ternary metal oxide compound having the following formula: $ABO_{3-\delta}$ or $ABO_{2-\delta}$, where A is a first metal, B is a second metal, and where $\delta$ is any number between about 0.0 and 0.5 optionally including a fractional part denoting an oxygen vacancy.

15. The home appliance of claim 10, wherein the coating layer includes a ternary metal oxide compound having the following formula: $ABXO_y$, where A is a first metal, B is a second metal, and where X is Al, Ce, Co, Cr, Eu, Fe, Ga, Gd, Mn, Nb, Pr, Sb, Sc, Sm, Ti, V, Y, Yb, or a combination thereof.

16. The home appliance of claim 10, wherein the coating layer includes a ternary metal oxide compound of $TiSn_9O_{20}$.

17. The home appliance of claim 10, wherein the coating layer includes a ternary metal oxide compound of $Cu_6SnO_8$, $Cu_3Mo_2O_9$, $CuMoO_4$, $Cu_3(MoO_3)_4$, $Zr_5Sn_3O$, $Ti(SnO_2)_2$, or a combination thereof.

18. The home appliance of claim 10, wherein the coating layer includes an intermetallic compound of $Ti_5Sn_3$, $Ti_6Sn_5$, $Ti_2Sn_3$, $TiMo_3$, TiZn, $TiCu_4$, $Ti_3Cu_4$, TiCu, or a combination thereof.

19. The home appliance of claim 10, wherein the coating layer includes an intermetallic compound of $TiZn_3$, $Ti_3Zn_{22}$, $TiZn_2$ or a combination thereof.

20. The home appliance of claim 10, wherein the coating layer has a bandgap of 1 eV or less.

* * * * *